United States Patent [19]

Hakansson

[11] Patent Number: 4,969,308

[45] Date of Patent: Nov. 13, 1990

[54] METHOD OF ATTACHING A DRINKING STRAW TO A PACK AND APPARATUS FOR CARRYING OUT THE METHOD

[75] Inventor: Jan T. Hakansson, Eslöv, Sweden

[73] Assignee: Tetra Pak Finance & Trading S.A., Pully, Switzerland

[21] Appl. No.: 373,835

[22] Filed: Jun. 29, 1989

[30] Foreign Application Priority Data

Jul. 15, 1988 [DE] Fed. Rep. of Germany ..... 3824013

[51] Int. Cl.[5] ..... B65B 61/00

[52] U.S. Cl. ..... 53/410; 53/128; 53/520

[58] Field of Search ..... 53/410, 128, 133, 520; 156/521; 493/379, 380

[56] References Cited

U.S. PATENT DOCUMENTS

| | | | |
|---|---|---|---|
| 3,812,572 | 5/1974 | Weikert | 53/410 X |
| 4,372,797 | 2/1983 | Dilot et al. | 53/410 X |
| 4,384,915 | 5/1983 | Utsumi | 156/499 |
| 4,572,758 | 2/1986 | Wild | 53/410 X |
| 4,584,819 | 4/1986 | Hakansson | 53/410 |
| 4,614,074 | 9/1986 | Evers | 53/410 X |

FOREIGN PATENT DOCUMENTS

| | | |
|---|---|---|
| 0129929 | 6/1984 | European Pat. Off. . |
| 2121756 | 5/1983 | United Kingdom . |

*Primary Examiner*—James F. Coan

*Attorney, Agent, or Firm*—Biebel, French & Nauman

[57] ABSTRACT

An apparatus for delivering in strip form packaged drinking straws, includes a device for severing the strip on a pivotal drum. The severing device pivots to transfer the individual packed straws to a vacuum cylinder, which is intermittently pivotal to pick up the individualized straws from the drum, and transfer the individual straws to a conveyor section. The conveyor section includes a continuous loop of track having an upper linear section of track and a lower linear section of track. A plurality of pressure arms are connected to the track where, each contains a vacuum holding mechanism adjacent to a free end for retaining the individual straws. The vacuum cylinder is mounted to a slide mechanism which is translatory relative to the upper linear section of the continuous track to position the individual packaged straws on the pressure arms of the conveyor mechanism. The pressure arms are pivotally controlled to pick up the individualized straws when the pressure arms are moving along the upper linear section and, when in the lower section of track, to position the straws adjacent to continuously moving containers to which the individualized packaged straws are attached.

20 Claims, 4 Drawing Sheets

Figure 1:
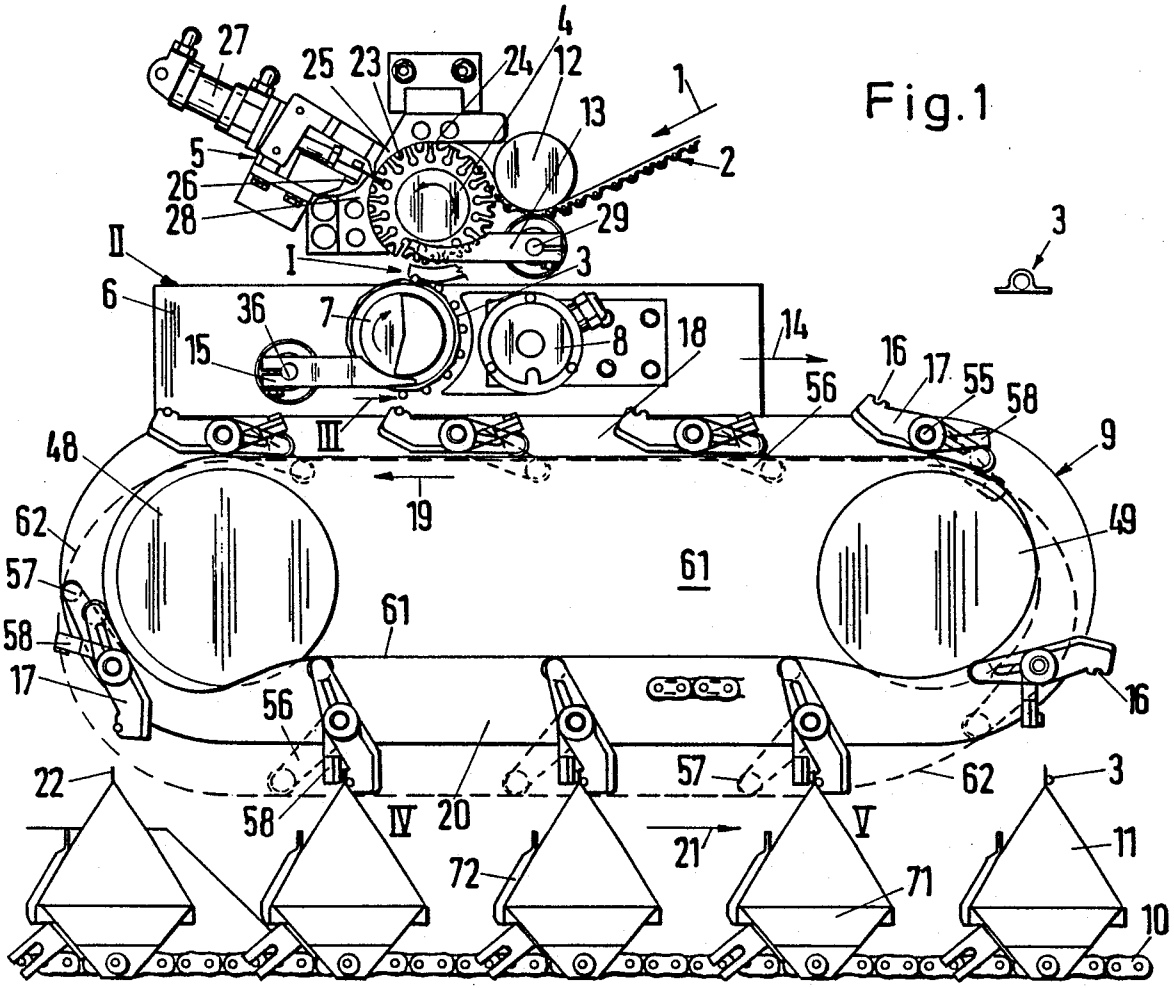

METHOD OF ATTACHING A DRINKING STRAW TO A PACK AND APPARATUS FOR CARRYING OUT THE METHOD

The invention relates to a method of attaching a packed drinking straw to a pack, and to an apparatus for that purpose, wherein the packs can be transported in a defined position on a conveyor which can be moved continuously at a first speed.

Liquid packs, where the contents are emptied by the final consumer partly with a drinking straw, are known. It is already known for drinking straws wrapped in plastic film or paper to be attached to liquid packs and for such packs to be sold commercially.

The attachment of drinking straws to packs creates problems, however, particularly when packs emerge from a high performance machine at high speed and have to be provided with a drinking straw immediately and sent on to other stations for further treatment.

The problem of the invention is to provide a method and apparatus for attaching a straw to a pack, in cases where the straw is itself in a pack.

According to the invention the method is characterised in that the packed drinking staws are supplied in the form of a strip, separated, held by vacuum and intermittently conveyed to a transfer station, from which the intermittent movement is converted to a continuous movement, and that the separated packed straws are then attached to continuously conveyed packs.

In high performance machines where liquid packs were continuously produced, e.g. from a web in tubular form, and were filled, sealed and moved away on a pack conveyor, it has not hitherto been possible to provide the packs emerging from the machine with a drinking straw immediately and to place them in an outer container in a reliable manner and at a uniform speed. As a means of overcoming the known drawbacks, the invention proposes that the straws should be placed in their own pack in the form of a strip, and that the packed straws should then be left in strip form and further processed. The straws may, for example, be placed on a continuously fed web of paper at an unspecified preparation station (not shown). A second web of paper may then be placed over the first one in a 'U' shape—as seen in cross-section to the first web—with the drinking straw inside the space formed by the 'U'. The free ends of the limbs of the 'U' are attached to the first web of paper by adhesion, crimping (or sealing in the case of plastic materials). This is done so that a sealing seam is formed between successive straws on the continuously fed first web, and so that the seam can be cut lengthwise to separate two straws. The drinking straw may be made of straw, plastics or the like and its pack is 'U' shaped in cross-section. The sticking, joining or sealing seam between two successive straws on such a strip must obviously be wide enough to keep the straw pack sealed on all sides, even when the individually packed straws are cut off the strip.

If the packed straws are supplied in strip form and if the conveying speed is high, the straws can clearly be conveyed equally fast. As the finished liquid packs move past continuously, the straws can finally be pressed on to them at the desired high speed.

It is known that The packed straws must be separated from the strip in a manner similar to the method described above, then moved on. They should desirably be moved on by moved parts of the machine, to which they are held by vacuum.

The invention further proposes that the packed straws supplied in strip form should first be moved intermittently, thereby greatly simplifying the separating station in particular. This proposal of moving the straws intermittently can only be combined with advantages if—further according to the invention—the intermittent movement is converted to a continuous one, for the packs to which the straws have to be applied move continuously in cases which have created problems in prior art. When the type of movement has been converted the separated, packed straw can then be attached to the continuously conveyed pack with synchronised movement.

According to the invention it is desirable for the intermittent movement to be converted to a continuous movement by moving the separated, vacuum held straw a certain distance at the same speed as the continuously conveyed packs and charging it into an attachment means. The advantages of moving the straws intermittently, particularly when they are being separated, are obvious. To convert the intermittent movement to continuous movement, the separated straw is moved at least a certain distance at the same speed as the continuously conveyed packs. In this way there is virtually a stationary state between the straw, conveyed at the same speed, and the pack over the said certain distance. An application device can clearly now transfer the vacuum held straw to the pack with simple means.

Further according to the invention, the separated, vacuum held drinking straw is advantageously mounted on the pack by clamping pressure, preferably at the seam which seals the pack. The straw is desirably attached by adhesion, hot sealing or the like. It is therefore helpful for it to be pressed onto the pack, even if only for a short time, e.g. while the pack is in an application section; this may be when the straw is being moved the said certain distance at the same speed, directly adjacent the pack and/or mounting device. In this way the straw can virtually be pressed into the mounting device, e.g. a pressure arm or tongs, directly and with simple means over a short distance, and can thereafter or alternatively be pressed onto the pack.

In a special, preferred embodiment the packed straw is moved a certain distance in the direction opposite that of the continuous movement, is stopped and then, when its movement has been reversed, is charged into the mounting means at the speed of the continuously conveyed pack. It may, for example, be preferable to arrange an intermediate conveyor supporting the mounting means between the conveyor, on which the packs are carried from the pack producing machine at equal intervals and in a specific position, and the separating device from which the packed straws are advanced in separated form and held by vacuum. Such an intermediate conveyor should desirably travel round continuously, as it has to deliver the straws to packs moving past continuously and fix them on the packs. A chain conveyor with a lower run and an upper run is therefore particularly favourable, for example with the straws being transferred to the pack in the lower run and being received in the upper run. It is particularly advantageous for the movement of the vacuum carried straws to be converted from intermittent to continuous between the chain conveyor and the separating station. As in a relay race the pressure arm which is to receive the straw should be moved at the same speed and in the same direction as the straw just separated for a certain distance, e.g. in a transfer section. The transfer from the vacuum holder to the pressure arm can then be carried out with particularly simple means. In a chain conveyor, preferably of the endless type, a reversing slide could be provided here in the region of the upper run. The slide could be shifted towards the chain conveyor, firstly at a far higher speed than the translatory speed of the chain conveyor or even of the continuously conveyed packs, to an end point, e.g. one end of the transfer section. When the slide has stopped, its direction of movement could be reversed, so that the pressure arms or mounting devices could be moved at the same speed and in the same direction close to the vacuum holding devices, e.g. a vacuum cylinder, over the whole transfer section, i.e. from its end to its beginning, e.g. approximately the length of the upper run of the chain conveyor. The transported straw undergoes conversion from intermittent to continuous movement in this transfer section, i.e. in the region of the upper run of the chain conveyor in the preferred embodiment. Further application to the pack, preferably to a seam sealing it, is then technically simple.

In an apparatus where the packs can be transported in a defined position on a conveyor which can be moved continuously at a first speed, the above-mentioned problem is solved, in that a movably controllable pressure arm has a means for holding the straw, and can be moved along an application section adjacent the pack conveyor at the same speed, in such a way that the straw is pressed on and attached along that application section. The starting point for the apparatus of the invention is a machine forming a continuous row of packs, which move continuously at uniform speed. The packs are spaced at uniform intervals on a conveyor and preferably have a translatory motion. Part of this straight piece is used as the application section, along which separated, packed straws are fixed to the pack. This is done by having holding devices moving along the application section at the same speed and in the same direction. Consequently the pressure arms are virtually stationary adjacent the packs substantially from the beginning to the end of the section, so that the straws can easily be transferred.

It is desirable, according to the invention, for a row of pressure arms to be arranged on an endlessly circling chain conveyor with tongs, arranged adjacent the pack conveyor, and for each pressure arm to have a cam follower, which is guided by a first control cam for controlled movement of the arm relative to the chain conveyor. The provision of a plurality of pressure arms corresponds to the row of packs emerging from the machine at equal intervals. If a large number of packs is to be produced per unit of time a high performance machine is required, and since the adhesion or attachment of straws to a pack takes a certain time, the output of the machine can be increased by the above-mentioned features. A first cam is responsible for the movement of the pressure arm relative to the chain conveyors with tongs. The movement is such that the arm travelling along a first conveying path assumes a receiving position, in which it receives the packed straws just separated. It then assumes a second position in which the straw is pressed onto the pack.

It is further advantageous, according to the invention, for a drum which is driven stepwise, with holding means for the straws at its periphery, to be arranged at substantially the opposite side of the chain conveyor to the pack conveyor, and for means to be provided for transferring the straws from the drum into the pressure arms. These measures are designed to separate straws supplied from a continuous strip and pass them to the pressure arms. At the described station in the apparatus a drum is provided rotatably, with holding means for the straws, so that the straws can be separated on the drum. This can be done by a cutter going in between two straws when the stepwise driven drum is stationary, and thus separating the packed straws in the manner described above.

In an advantageous embodiment of the invention the means for transferring the straws from the drum to the pressure arms include a reversing slide, which is driven at least partly synchronously with the chain conveyor. It will be appreciated that there are problems in transferring the straws from one station to the next, since the parts are moving in different ways. In the end the straws have to be mounted on continuously moving packs. It is therefore desirable to use a continuously driven chain conveyor with tongs. Yet there is still the problem of transferring the straws to be synchronously running chain conveyor from a stepwise, i.e. partly stationary position. As the invention provides for the strip of straws to be separated on the drum, the reversing slide has also been provided. This can make a translatory, strokelike movement, e.g. receiving a straw when stationary and passing it to the chain conveyor during one of its moving phases.

In accordance with the invention it is desirable for a vacuum cylinder to be arranged on the reversing slide and driven stepwise, synchronously with the drum 4, and for means to be provided for transferring a separated, packed straw from the drum onto the vacuum cylinder and from there into a pressure arm. Vacuum is used to retain the straws, at least when they are on the reversing slide. It will be appreciated that a vacuum line can perfectly well be taken from the stationary machine to the slide through hoses. However the drum is driven stepwise, the stepwise movement of the vacuum cylinder on the slide makes it receive the straw without moving, provided that the drum is also immobile. The straw is then transferred to one of the row of pressure arms on the chain conveyor by suitable means.

It may be advantageous for this purpose for an opposing clamping arm, which can be controlled by a second cam, to be provided on the chain conveyor adjacent each pressure arm. In this way the pressure arm and opposing clamping arm can work together like a pair of tongs. A separated straw held by the pressure arm can then be pressed against flaps, sealing seams or the like on the pack, since the force encounters an opposing force. This does not exclude the possibility, according to the invention, of a single arm being moved on the chain conveyor and pressed against the pack so that the counterpressure is provided by the contents, i.e. by the pack itself. But the advantage of using a pressure arm with an opposing clamping arm is clear: in the application section and with appropriate control of the two arms of the tongs, the straw which has left the cylinder on the reversing slide can be pressed against a sealing seam on the pack, clamped into position and can even move along with the pack in the clamped position for a time.

In a further advantageous embodiment of the invention, the means for holding the straw on the pressure arm is a recess with a vacuum hole, and vacuum lines are provided, which can be moved with the chain conveyor and connected to a stationary vacuum passage. It has already been mentioned that the straw is held on the cylinder by vacuum. This enables it to be turned upside down, e.g. rotated through 360° with the vacuum cylinder without changing its position unfavourably. But the invention also provides for the straw to be held to the pressure arm by vacuum. The vacuum lines extending from the holes in the pressure arm to the eventually stationary vacuum device must be suitably designed. The invention provides, for example, for a stationary vacuum passage to be provided inside at least part of the chain conveyor, e.g. engaging round a chain wheel in a 'U' shape. The means described below are provided, particularly a sliding belt containing at least one hole, to transmit the vacuum from the centre of the chain to parts extending outside it with the pressure arms rotatably attached to them. In an appropriate embodiment of the invention the strip of packed straws coming from a supply reel is guided over a first direction changing roll onto the drum which can rotate stepwise about a horizontal axis. A large number of recesses, evenly spaced around the periphery of the drum, are trough-shaped and large enough to contain a packed straw. It has already been explained above that the straw pack is preferably made by taking a substantially flat strip of paper, sheeting or the like, and placing a second strip over it in a sinusoidal or 'U' shape, so that a drinking straw can fit into the pouch or the interior of the 'U' with a spacing such that the strip can be fitted exactly onto the drum. When the strip of straws is threaded in one only has to ensure that there is one flat strip of packing on the outside and that the 'U' shapes move radially inwards into the above-mentioned recesses in the drum. Guide rails are responsible for holding the strip in the drum. When the strip has been correctly placed on the drum by the guide rail, e.g. along the periphery of a first quadrant of the drum, it enters the cutting station. For this purpose the periphery of the drum contains slots between the trough-shaped recesses, and these slots extend radially deeper towards the centre of the drum than the recesses. At the cutting station a cutter is driven intermittently with a stroke-like action by a pneumatic pressure cylinder, so that whenever the drum stops there is a slot opposite the cutter. The cutter can then enter the slot and sever the strip along the seam between two straws. When the drum is turned further the packed, separated straws are kept in their recesses by a further guide rail and moved into a "lower" discharge position, which may be 180° away from the "upper" initial insertion position. The periphery of the drum also contains two grooves which are spaced longitudinally of the drum and over which the straws lie. There is a transfer finger within each groove in the lower discharge area, over which the straw is passed when it leaves the second, last guide rail. During its passage the straw thus lies in a recess in the finger at two points and can be lifted out of the drum radially when the finger is turned. This is not exactly a radial movement, for the finger turns in a circle about an axis, yet the straw is substantially lifted radially off the periphery.

The straws are lifted onto the vcuum cylinder, which is also driven stepwise and arranged "below" on the reversing slide, when the cylinder is firstly in the second end position and secondly is stationary. A stepping motor is preferably mounted on the reversing slide. This advances the vacuum cylinder one step while the slide is moving into its first starting position in a translatory motion with great acceleration. A step takes as long as a stroke of the slide.

The vacuum cylinder has a polygonal periphery, and when the operation is under way straws will lie in the 'U' shaped troughs over about half the periphery of the drum, and separated straws will be held by vacuum over about half the periphery, with the flat part of the packing strip now lying on the flat peripheral part of the cylinder and the straw projecting radially outwards.

In operation the reversing slide is stopped at its first starting position and moved back at a lower speed to its second end position. This lower speed is equal to that at which the row of pressure arms on a chain conveyor "below" the slide moves continuously.

The vacuum cylinder, containing at least one peripheral groove, has a second transfer finger arranged rotatably beside it. When the finger is turned a separated straw is lifted substantially radially off the vacuum cylinder and inserted in a trough-like recess in the pressure arm opposite. Vacuum is now applied to the pressure arm, securing the straw and taking it to the beginning of the application section; the upper run of the chain conveyor is opposite the reversing slide, and the application section is adjacent the lower run of the chain conveyor. The first and second control cams are in the region of the chain conveyor with tongs. The cams guide the pressure arm and opposing clamping arm of each particular pair of tongs, so that the pressure arm is laid against a pack located "below it" and guided parallel with the lower run of the chain conveyor. The opposing clamping arm then presses against it so that a seam sealing the pack to which the straw is to be attached is between the two arms. This is done in such a way that the packed straw is in the desired position relative to the pack. In the region of the application section the arms of the tongs on the chain conveyor move at the same speed and in the same direction as the packs on the pack conveyor, until the end of the application section is reached. Here the tongs are opened by the cams and the purpose of the apparatus is achieved, in that the straw is now on the pack.

Figure 2:
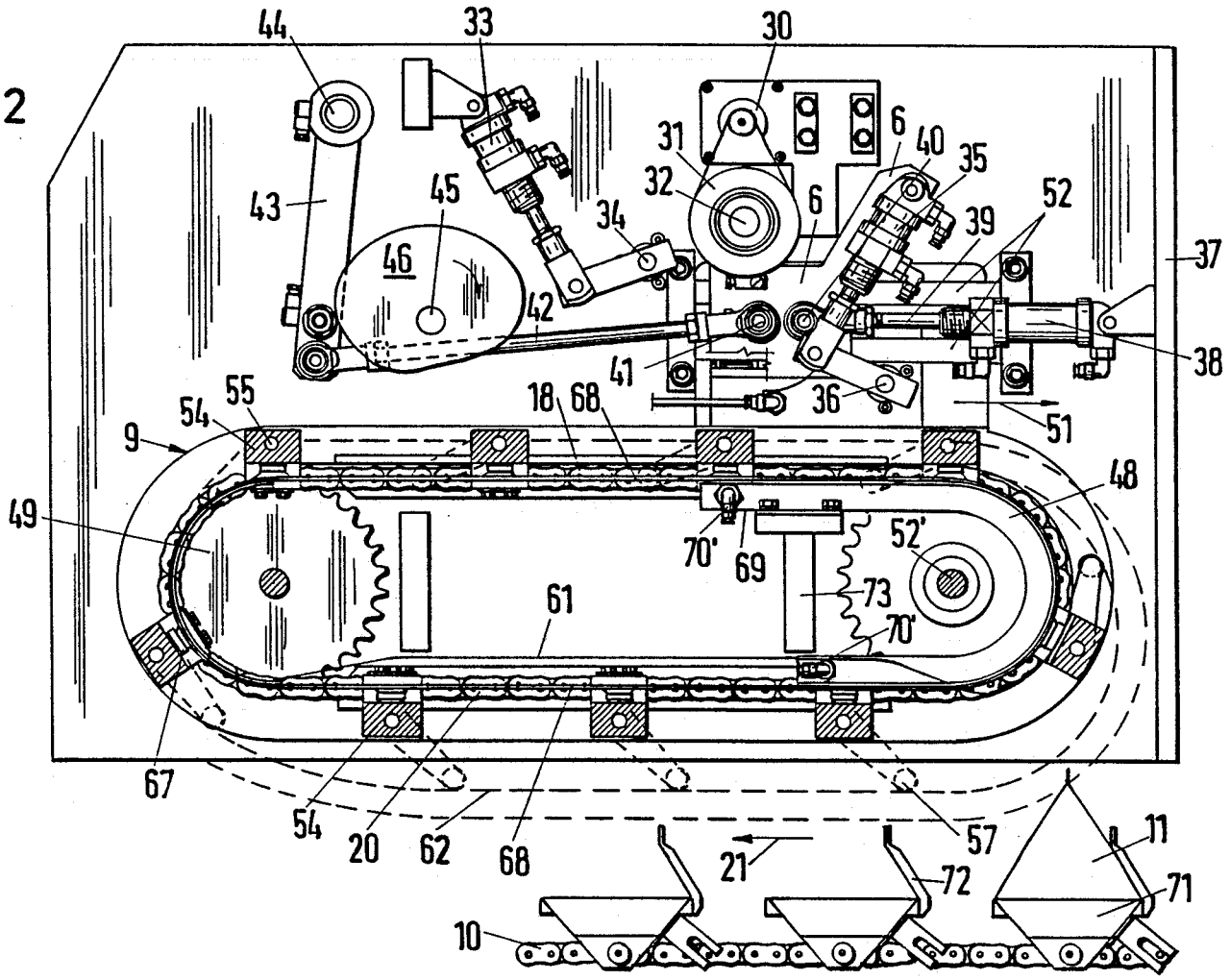
Figure 3:
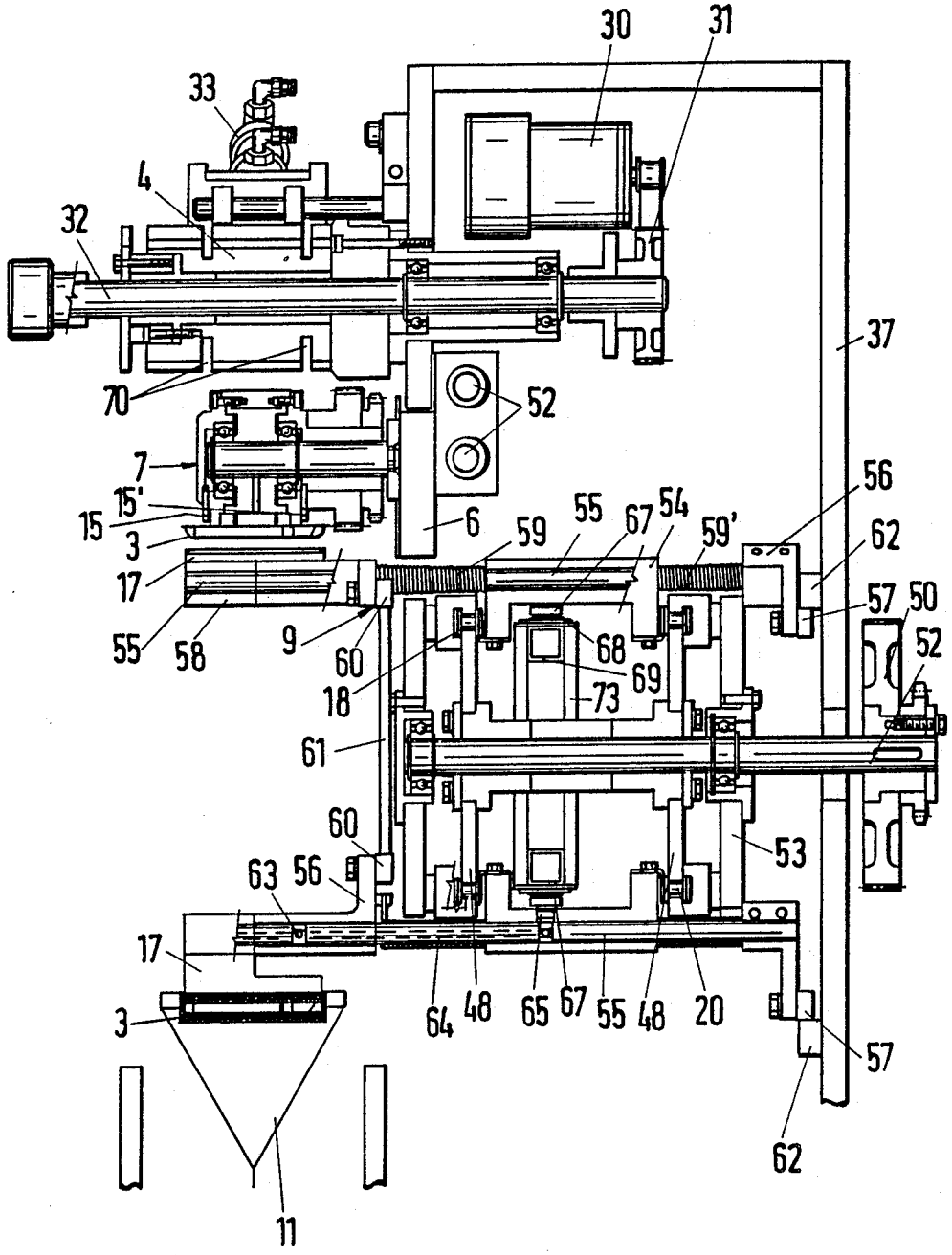
Figure 4:
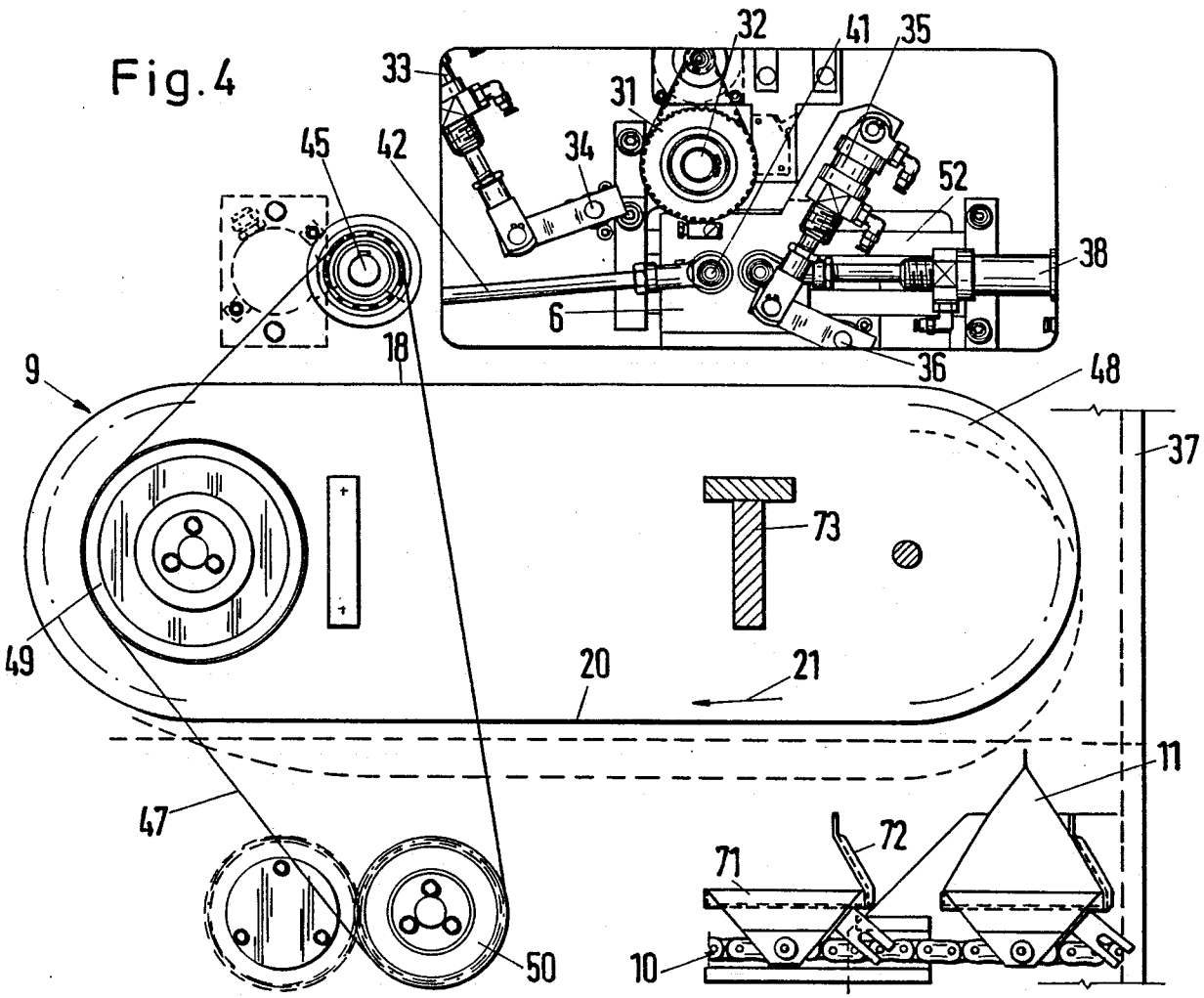

Other advantages, features and applications of the invention will emerge from the following description of a preferred example and from the drawings. In these:

FIG. 1 is a diagrammatic side elevation of the apparatus according to the invention, including the drum, the vacuum cylinder on the reversing slide, the tongs conveyor and the pack conveyor, FIG. 2 is a view of the apparatus from the opposite side, with the tongs conveyor consequently seen as rotating in the opposite direction, FIG. 3 is a substantially vertical section, though taken in different planes, with the drum, the vacuum cylinder and one of the two pairs of chain gear wheels shown in section through their axes, and FIG. 4 is another diagrammatic view in which parts of the apparatus are omitted and the synchronous drive between the pack conveyor, the tongs conveyor and the reversing slide is shown.

In FIG. 1 one can see the strip 2 of packed drinking straws fed in in the direction of the arrow 1, with a separated, packed straw shown at 3. At the top of the figure is the drum 4, rotatable stepwise in the direction of the curved arrow, and radially at the top left is the cutter shown generally at 5. Below the cutter is the reversing slide 6 with the vacuum cylinder 7, turning in the opposite direction to the drum 4 as indicated by the curved arrow and also driven stepwise by the stepping motor 8 fixed to the reversing slide 6. Below the slide 6 is the chain conveyor 9 with tongs, and right at the bottom is the pack conveyor 10 with packs 11.

The strip 2 of packed straws 3 moves in the direction of the arrow 1, over a first direction changing roll 12 onto the drum 4, and is processed by the cutting station 5 so that separated, packed straws 3 are transferred by a first pair of fingers 13, 13' at position I to the vacuum cylinder 7 fixed to the reversing slide 6. The cylinder is in the second end position II, shown in continuous lines in FIG. 1, and thereafter moves in the direction of the arrow 14 with great acceleration, into a first starting position (not shown) at the right hand side of FIG. 1, where the slide is stopped. The clockwise rotation on the vacuum cylinder 7 has in the meantime brought the separated straw 3 into the position III right at the bottom. Here in position III a second pair of transfer fingers 15, 15' lifts the lowermost straw 3 off the vacuum cylinder 7 and places it in the recess 16 in a pressure arm 17, where it is retained by vacuum. The transfer takes place while the slide 6 is moving in the direction opposite that of the arrow 14, i.e. to the left in FIG. 1, at the same speed as the upper run 18 of the chain conveyor, 9 which moves at a slower, uniform speed in the direction of the arrow 19.

The separated straw is carried down to the lower run 20 in this way. Below the run 20 the pack conveyor 10 moves at the same speed in the direction of the arrow 21, so that the straw 3 is attached to the sealing seam 22, projecting upwards towards the chain conveyor 9, in the manner shown. The upwardly projecting seam 22 can be seen at the left hand side of FIG. 1 without the straw 3 and at the right hand side with the straw.

The various stages in the operation of the machine will now be described.

DRUM 4 AND CUTTING STATION 5

The drum 4 is driven stepwise about a horizontal axis in the direction of the curved arrow. It contains trough-like recesses 23 in its periphery; these are spaced evenly over the whole outer periphery of the drum 4, to match the spacing of the straws 3 in the strip 2. Between all the recesses 23 there is a cutting slot 24 extending radially inwards from the outer periphery towards the centre, so that there is a cutting slot 24 adjacent each U shaped, trough-like recess 23.

An arcuate guide rail 25 is mounted in the upper portion adjacent the first direction changing roll 12. Its lower surface, facing towards the drum 4, first extends horizontally, to help to thread in and press in the strip 2 of straws 3 running onto the drum 4 next to the first roll 12. The insertion of the straws 3 in the recesses 23 is completed substantantially in the upper part of the drum, at the end of the straight horizontal underface of the first guide rail 25. Consequently the adjoining part of the underface of the rail 25 is curved to match the periphery of the drum 4 and ends immediately before the cutter 26. The pneumatic pressure cylinder 27 moves the cutter radially towards the drum 4 with a stroke-like action, so that the cutter can enter the slot 24 and separate the packed straws 3 whenever the drum stops.

When the packed straws 3 have been separated by the second guide rail 28, they are each held in their respective U-shaped recesses 23 until they reach a position in region I substantially diagrametrically opposite the place where the straw was inserted. Here the rotation of the drum has brought the straw 3 to above a recess in the first pair of transfer fingers 13. The fingers can move about the axis 29 to the position shown broken off at position I in FIG. 1.

REVERSING SLIDE 6

Thus in position I the transfer fingers 13 have transferred the separated straw 3 to the many cornered peripheral surface of the vacuum cylinder 7, which turns clockwise in the direction of the curved arrow (FIG. 1).

While the drum 4 is driven by the stepping motor 30, mounted stationary in FIGS. 2 to 4, via the shaft 32 by means of the chain gear 31, the first transfer finger 13 is moved by the pneumatic air cylinder 33 and the shaft 34 turned thereby. The transfer fingers 13, 13' are fixed adjustably to the shaft 34 by screws.

The drive for the reversing slide 6 is shown in FIG. 2. It will also be seen from this figure that the air cylinder 35 is similarly mounted on the slide 6. Like the cylinder 33 the air cylinder 35 turns a shaft 36 to and fro with a short stroke, and the second pair of transfer fingers 15 is seated on the shaft 36 (FIG. 1). Since FIG. 1 is turned sideways from the FIG. 2 position, the shaft 36 fixed rotatably to the slide 6 is at the left hand side, whereas in FIGS. 2 to 4 it is at the right.

A pneumatic air cylinder 38 is also mounted on the frame 37. Its piston rod 39 is joined to the reversing slide 6 at the articulation point 40. As will be seen from FIG. 3, the slide is plate shaped. A second point of articulation 41 can be seen somewhat further to the left in FIG. 2. Here a drive rod 42 is rotatably connected to a cam follower arm 43, which turns round the shaft 44 according to the position of the cam 46 rotatable about the shaft 45.

It will be seen from FIG. 4 that the shaft 45 of the cam 46 is connected by the belt 47 synchronously with the rotation of the pair of chain gear wheels 49 and the driving pulley 50 of the pack conveyor 10. Thus in the case of a chain or chain belt 47 the cam 46 is guaranteed to move synchronously with the chain conveyor 9 with tongs and also with the pack conveyor 10.

In FIG. 1 the reversing slide 6 is in its second end position II, which it has not quite reached in FIG. 2, as can be seen from the position of the cam plate 46. If the cam plate 46 turns a bit further in the direction of the curved arrow drawn in it in FIG. 2, this decreases the distance between its outer surface and the shaft 45, so the drive rod 42 moves the slide 36 still further to the right in the direction of the arrow 51, and the piston 39 is drawn further into the cylinder 38. When the piston 39 has reached its end position the slide 6 is thus in its second end position II. From here it is moved along guide rods 52 into the first starting position (not shown), by being reversed after being stopped by compressed air impinging on the cylinder 38. This movement of the slide 6 takes place not only with great acceleration but also at a considerably higher speed than that at which the chain conveyor 9 travels round or its upper run 18 or lower run 20 moves. When the first starting position has been reached, with the slide 6 at the left hand side in FIG. 2, the pressure cylinder 38 reverses and draws the slide 6, or endeavours to draw it to the right in the direction of the arrow 51. But this backward movement to the second end position II cannot be faster than permitted by the cam 46, for the cam is synchronously connected to the drives 49, 50 by the belt 47 (FIG. 4). Hence the slide, as shown in FIG. 1, moves to the left in the direction of the arrow 19 to its second end position II at the speed of the upper run 18 of the chain conveyor 9 with tongs.

Position III in FIG. 1 is taken to be further to the right, namely when the slide 6 has reached its first starting position. In this position the cylinder 35 actuates the shaft 36, lifts the lowermost straw 3 off the vacuum cylinder 7 with the pair of transfer fingers 15, and presses it into the recess 16 in the pressure arm 17. This takes place while the slide 6 and the upper run 18 of the chain conveyor 9 are moving in the direction of the arrow 19. In this way the straw is transferred to the chain conveyor 9 with tongs.

CHAIN CONVEYOR 9 WITH TONGS

As shown in FIG. 3, the chain conveyor 9 is driven by the pulley 50 and the shaft 52, which is mounted in the cradle 53 of the frame 37 by means of unspecified ball bearings. The chain links in the upper run 18 and lower run 20 are indicated at the top and bottom by the pair of chain gears 48 (FIG. 3). A bridge 54 is located and coupled to the chain links between the chain of one gear and the chain of the opposite gear. This bridge engages over a shaft 55 extending from the retaining arm 56 of a cam follower roller 57 to the opposing clamping arm 58. The arm 58 is rotatable about the shaft 55 together with the pressure arm 17 and is shown in the top and bottom at the left hand side of FIG. 3. Counter pressure springs 59, 59' engage round the shaft 55 to the left and right of the substantially central bridge 54. While the arm 58 is associated with the cam follower roller 57, which rotates it in a controllable manner, the pressure arm 17 is associated with the cam follower roller 60, which turns the pressure arm 17 around the shaft 55 with corresponding control. The first control cam 61, in the shape of an elongated disc, can be seen from FIGS. 1 to 3. The disc shape is clearly recognisable from FIG. 3. A second control cam 62 is arranged opposite it in FIG. 3 and can be seen in FIGS. 1 and 2 as a broken line on the outside. The distance moved by the shaft 55 is determined only by the path travelled by the chain conveyor 9. The controlled rotation of the pressure arm 17 and of the clamping arm 58 about the shaft 55 takes place against the pretensioning force of the respective torsion spring 59 or 59' by means of the control cams 61, 62.

It will be seen from FIG. 1 that the opposing clamping arm 58 is fixed to the supporting arm 56 at an acute angle of approximately 45°, while the cam follower roller 60 of the pressure arm 17 is arranged as an extension of the latter, forming a substantially prolate shape for the arm 17. By means of the two cams, 61 and 62, (FIG. 1) the pressure arm 17 adopts a lying position as it moves anticlockwise from the right end of the upper run 18, and remains in that position as far as the downstream or left end of the run 18. During that time the arm 58 is in a position in which it is swung open to the right about the shaft 55 so that it remains substantially above the upper run. This is the appropriate position for straws to be transferred to the opening 16 in the pressure arm 17 by the fingers 15. As it continues in the direction of movement 19 the arm 58 starts moving into the closed position at the bottom left hand position in FIG. 1. This is done by having the second cam 62 move way from the shaft 52 of the chain gear wheels 58. But the pressure arm 17 with the straw 3 is first applied to the same 22 on the pack 11 in the bottom left hand area of FIG. 1. This movement is produced by the first cam 61 moving towards the shaft 52 on which the gear wheels 48 rotate, as can be seen from the bottom right hand quadrant of the left hand gear wheel 48 in FIG. 1. At the same time the arm 58 is turned anticlockwise from the rear, clamping in both the seam 22 and the straw 3. In position IV, in the bottom left hand area of FIG. 1, the tongs comprising the two arms 17 and 58 are thus closed and the straw pressed firmly onto the seam 22. It remains pressed against the seam as it travels in the direction of the arrow 21, until it reaches the bottom right hand position V. Here the cams 61, 62 move towards one another again, causing the pressure arm 17 to be turned anticlockwise and the clamping arm 58 clockwise, i.e. opening the tongs, before they return to the lying position at the beginning of the upper run 18.

Hot melt has previously been sprayed onto the surface of the sealing seam 22 of the pack 11 to which the packed straw 3 is later to be applied. The spraying device is not shown, and the process is controlled by a photocell and may follow an exact spot pattern.

VACUUM MEANS OF CHAIN CONVEYOR 9

When the separated straw 3 is charged into the pressure arm 17, i.e. when it leaves the slide 6, it is held in the recess 16 in the arm 17 by the force of the vacuum, particularly when the arm 17 is travelling round in the left hand part of the chain 9 in FIG. 1 or the right hand part in FIG. 2. Thus the vacuum is applied to the movable parts travelling round but is generated under stationary conditions in the machine.

A vacuum opening 63 provided for the purpose in the pressure arm 17 can be seen in FIG. 3. The opening is connected to a vacuum line 64 extending through the centre of the shaft 55 and parallel with the shaft. The line 64 has a flow connection, via a nipple 65, to a suction device 66 with a discharge hole (not shown). The suction device 67 is fixed to a belt 68 which travels round parallel with the chain conveyor 9. The belt is made of plastics, rubber or the like and adapted to slide over a stationary vacuum passage 69. Vacuum connecting nipples 70' are seated at the beginning and end of a vacuum passage 69 extending round the right hand shaft 52' of the right hand pair of chain gear wheels 48 in a U-shape. The passage 69 has a square cross-section as shown in FIG. 3, but has the shape of a horizontal 'U' in the side view in FIG. 2, with one limb of the 'U' possibly being smaller than the other. It is important for the passage 69 to start at the point in the movement of the straw 3 where the straw is removed from the vacuum passage 7 and transferred to the recess 16 in the pressure arm 17, so that it can be carried and held there by the arm 17 until the tongs have closed in position IV. Then the vacuum can be switched off, i.e. the vacuum passage 69 can end, as indicated by the lower vacuum connecting nipple 70' in FIG. 2.

The outer elongated surface of the passagelike, stationary vacuum chamber 69 contains a plurality of small holes. The distance between the holes is smaller than the length of a suction device 67 or of a hole in the rubber belt 68 below the suction device. In this way the opening in the suction device and the hole in the rubber belt 68 in the region of the vacuum chamber 69 is continuously over a hole and hence connected to vacuum. The other holes in the chamber 69 are sealed by the belt 68.

It will be clear from the above description how vacuum is taken from the stationary, passagelike chamber 69, through the hole in the rubber belt 68, the suction device 67 and the nipple 65, into the vacuum pipe 64 and through the opening 63 into the pressure arm 17.

The pair of peripheral grooves 70 in which the first pair of transfer fingers 13 engage when in the upper position in FIG. 1 can be seen in the drum 4 at the top of FIG. 3.

The transporting container 71 for the packs 11, with the sliding and supporting arm 72 at the back, can be seen from FIGS. 1, 2 and 4.

It will also be seen from FIG. 2 that the maximum stroke of the piston 39 for the movement of the reversing slide 6 is equal to the difference between the largest and smallest diameter of the cam plate 46.

The vacuum passage 69 is fixed to the cradle by supports 73.

The grooves 70 and the drum 4 mentioned on page 14, line 23 of the German (page 9, line 4 of the English) are arranged so that an imaginary plane extending through the respective circular groove 70 is perpendicular to the axis of the drum.

I claim:

1. A method of attaching packed drinking straws to continuously moving containers, the method comprising the steps of:

supplying the packed drinking straws in the form of an intermittently fed strip;

separating the strip into individually packed drinking straws;

converting the intermittently fed individually packed drinking straws to a continuous linear speed, by first moving the straws in a translatory direction, and subsequently grasping the straws and moving them at the same linear speed as the containers;

positioning the straws adjacent to the containers; and attaching the individually packed straws to the continuously moving containers.

2. The method of claim 1, wherein the step of converting from intermittent to continuous linear speed includes the step of moving the individually packed straws in a continuous loop at a constant linear speed.

3. The method of claim 2, wherein the individually packed straws are first moved a certain distance in a direction opposite to that of the continuous loop, and then subsequently moved in the continuous loop.

4. The method of claim 2, wherein the individually packed straws are grasped by vacuum when in the continuous loop.

5. The method of claim 1, wherein subsequent to the severing step and prior to moving the straws in a translatory direction, the individually packed drinking straws are held by vacuum.

6. The method of claim 1, wherein the individually packed straws are attached by clamping the straws to the containers.

7. The method of claim 6, wherein the straws are clamped to the sealing seam of the containers.

8. An apparatus for attaching a packaged straw to a container, where the packaged straws can be moved continuously at a first speed, the apparatus being characterized in that:

the apparatus has at least one movably controllable pressure arm having means for holding a packaged straw, the apparatus further comprising means to move the pressure arm along a conveyor carrying such containers, at the same linear speed as the conveyor, the apparatus further comprising pressing means to attach the packaged straw to the container, while the containers are continuously moving.

9. The apparatus of claim 8, characterized in that a row of pressure arms is arranged on an endlessly circling chain conveyor with tongs, arranged adjacent the container conveyor, and that each pressure arm has a cam follower, which is guided by a first control cam for controlled movement of the arm relative to the chain conveyor.

10. The apparatus of claim 9, characterized in that a drum which is driven stepwise, with holding means for the straws at its periphery, is arranged at substantially the opposite side of the chain conveyor to the container conveyor, and that means are provided for transferring the straws from the drum into the pressure arms.

11. The apparatus of claim 10, characterized in that the means for transferring the straws from the drum to the pressure arms include a reversing slide, which is driven at least partly synchronously with the chain conveyor.

12. The apparatus of claim 11, characterized in that a vacuum cylinder is arranged on the reversing slide and driven stepwise, synchronously with the drum, and that means are provided for transferring a separated, packed straw from the drum onto the vacuum cylinder and from there into a pressure arm.

13. The apparatus of claim 12, characterized in that an opposing clamping arm, which can be controlled by a second cam, is provided on the chain conveyor adjacent each pressure arm.

14. The apparatus of claim 13, characterized in that the means for holding the straw on the pressure arm is a recess with a vacuum hole, and that vacuum lines are provided, which can be moved with the chain conveyor and connected to a stationary vacuum passage.

15. An apparatus for attaching a packed drinking straw to a continuously moving container, the apparatus comprising:

feed means for feeding a strip of packaged straws;

separator means for separating the strip into individual packaged straws;

slide means for two directional translatory movement of the individual packaged straws;

transfer means to transfer the individual straws from the separator means to the slide means;

continuous conveyor means having individual straw retaining arms, the slide means being movable in a transverse sense relative to the continuous conveyor means, to position individual separated straws into the straw retaining arms, the conveyor being adapted to move the straw retaining arms to a position adjacent to the containers and attach the individual packaged straws onto the containers.

16. The apparatus of claim 15, wherein the continuous conveyor means comprises a continuous loop track, having an upper linear travel section and a lower linear travel section, where the slide means is positioned adjacent to and translatory relative to, the upper linear travel section of the loop, and where the lower linear travel section is positioned adjacent to the continuously moving containers.

17. The apparatus of claim 16, wherein the straw retaining arms each include grasping means for grasping the individual packaged straws, and the transfer means comprises first timing means adapted to pivot the straw retaining arms with the grasping sections facing upwardly when the straw retaining arms are moving along the upper linear section, and to pivot the straw retaining arms downwardly with the grasping section facing the container, when the straw retaining arms are moving along the lower linear section.

18. The apparatus of claim 17, further comprising clamping means comprises a clamping arm pivotally fixed to the straw retaining arm, and second timing means adapted to pivot the clamping arm into a position away from the straw retaining arm when the straw retaining arm is moving along the upper linear section, and to pivot the clamping arm behind the container when the straw retaining arm is moving along the lower linear section, thereby clamping the individually packed straws to the container between the grasping section and the clamping arm.

19. The apparatus of claim 16, wherein the continuous conveyor means further comprises a clamping arm adjacent to the straw retaining arm, the arms being adapted for clamping the individual straws against the containers.

20. The apparatus of claim 16, wherein the transfer means comprises a pivotal drum positioned between the separating means and the slide means, the drum being intermittently pivotal to transfer the individual separated straws to the slide means.

* * * * *